US008413859B2

(12) United States Patent
Schneider et al.

(10) Patent No.: US 8,413,859 B2
(45) Date of Patent: Apr. 9, 2013

(54) NOZZLE ASSEMBLY FOR A DISPENSING DEVICE

(75) Inventors: Mark C Schneider, Moorestown, NJ (US); Joseph B Hanni, Cherry Hill, NJ (US)

(73) Assignee: Albion Engineering Co., Moorestown, NJ (US)

( * ) Notice: Subject to any disclaimer, the term of this patent is extended or adjusted under 35 U.S.C. 154(b) by 493 days.

(21) Appl. No.: 12/720,827

(22) Filed: Mar. 10, 2010

(65) Prior Publication Data

US 2011/0220687 A1 Sep. 15, 2011

(51) Int. Cl.
*B65D 25/48* (2006.01)

(52) U.S. Cl. ..... 222/568; 222/526; 222/548; 222/570

(58) Field of Classification Search ..... 222/566–568, 222/570, 526, 533, 537, 548, 553
See application file for complete search history.

(56) References Cited

U.S. PATENT DOCUMENTS 2,530,999 A * 11/1950 Schuler ..... 222/567
4,461,454 A * 7/1984 Vadnais ..... 251/350
4,728,007 A * 3/1988 Samuelson et al. ..... 222/182
4,848,973 A * 7/1989 Yokota et al. ..... 405/263
5,503,090 A * 4/1996 Guzan ..... 111/7.2
6,386,872 B1 * 5/2002 Mukasa et al. ..... 433/90
2008/0089967 A1 * 4/2008 Bourque ..... 425/183
2009/0200303 A1 * 8/2009 Lafond ..... 220/258.4
2010/0213213 A1 * 8/2010 Albers et al. ..... 222/153.05
2011/0091590 A1 * 4/2011 McMahon et al. ..... 425/87

* cited by examiner

*Primary Examiner* — J. Casimer Jacyna
(74) *Attorney, Agent, or Firm* — Caesar, Rivise, Bernstein, Cohen & Pokotilow, Ltd.

(57) ABSTRACT

A nozzle assembly for use with a device for dispensing a flowable material, such as caulking material, is disclosed. The nozzle assembly includes a conduit having an inlet end adapted for connecting to the dispensing device, an outlet end, and a longitudinally extending passage therethrough. A head assembly is arranged to be rotatably mounted to the conduit outlet end. A nozzle is arranged to be affixed within the head assembly, the nozzle comprising a larger diameter inlet opening, a smaller diameter outlet opening, and a tapered wall comprising a notched portion which, together with the outlet opening forms a dispensing opening. The nozzle is arranged to rotate in response to rotation of the head assembly to any one of a plurality of positions for directing a bead of flowable material onto a surface.

9 Claims, 5 Drawing Sheets

10
26
26a
14
18
22
26b
30
34
42
38
48
46
60

26a
14
10
26
22
26b
18
36
34
54
30
58
50
38
48
46

NOZZLE ASSEMBLY FOR A DISPENSING DEVICE

FIELD OF THE INVENTION

The present invention relates generally to a rotating nozzle assembly for dispensing flowable materials, such as caulk, sealant or other flowable materials from a dispensing device, such as a caulk gun.

BACKGROUND OF INVENTION

During the production of automotive vehicles, for example, a fabricator uses a dispensing gun to apply a bead of sealant to the vehicle frame prior to the installation of an automobile windshield. The bead is applied along a pinch-weld in the frame defining the windshield periphery, and the windshield is positioned thereon. One edge of the windshield is applied to the adhesive bead in the pinch weld, and then the windshield is released and pressed into place. When using a conventional dispensing device to apply such a sealant bead, each time another corner of the windshield periphery is reached, it is necessary for the operator to reposition his body and/or the dispensing device to change the direction in which the bead of sealant is dispensed from the device. Such repositioning is time consuming and inconvenient to the operator. The present invention overcomes these drawbacks by providing a rotatable nozzle assembly in combination with a dispensing device. The direction from which the sealant bead is dispensed from the nozzle can be adjusted by simply rotating the nozzle assembly during dispensing, thus eliminating such inconvenient and time consuming repositioning of the operator's body and the dispensing device.

SUMMARY OF THE INVENTION

A nozzle assembly for use with a device for dispensing a flowable material, such as caulking material, is disclosed. The nozzle assembly includes a conduit having an inlet end adapted for connecting to the dispensing device, an outlet end, and a longitudinally extending passage therethrough. A head assembly is arranged to be rotatably mounted to the conduit outlet end. A nozzle is arranged to be affixed within the head assembly, the nozzle comprising a larger diameter inlet opening, a smaller diameter outlet opening, and a tapered wall comprising a notched portion which, together with the outlet opening forms a dispensing opening. The nozzle is arranged to rotate in response to rotation of the head assembly to any one of a plurality of positions for directing a bead of flowable material onto a surface.

DETAILED DESCRIPTION OF THE INVENTION

Figure 1:
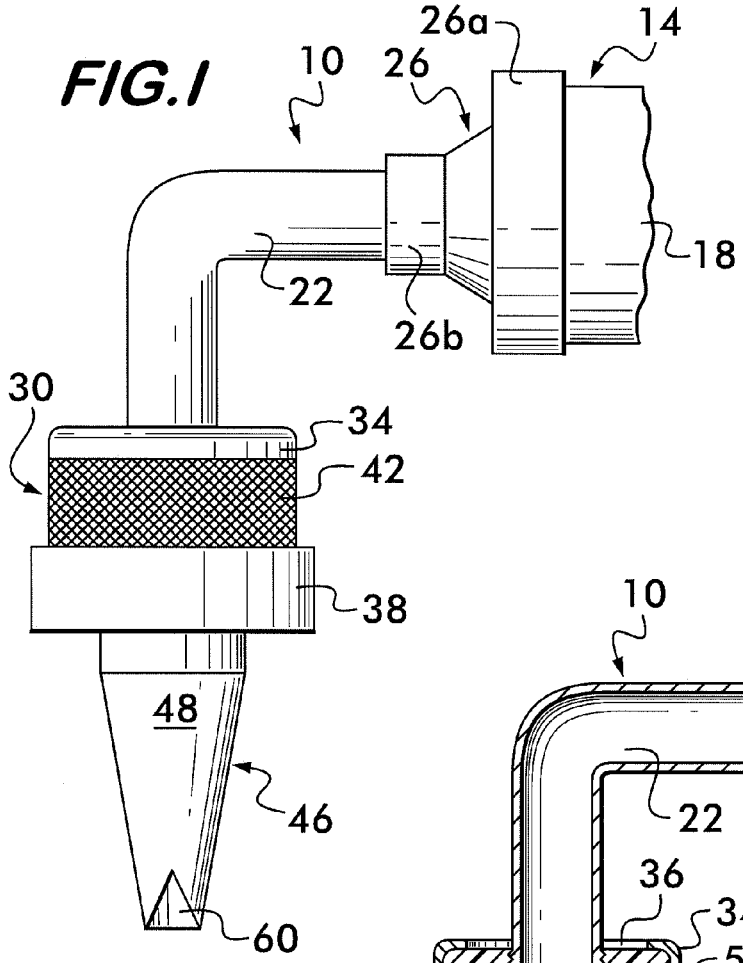
FIG. 1 is a perspective view of the nozzle assembly of the present invention affixed to the dispensing end of a device for dispensing flowable materials such as caulking materials.
Figure 2:
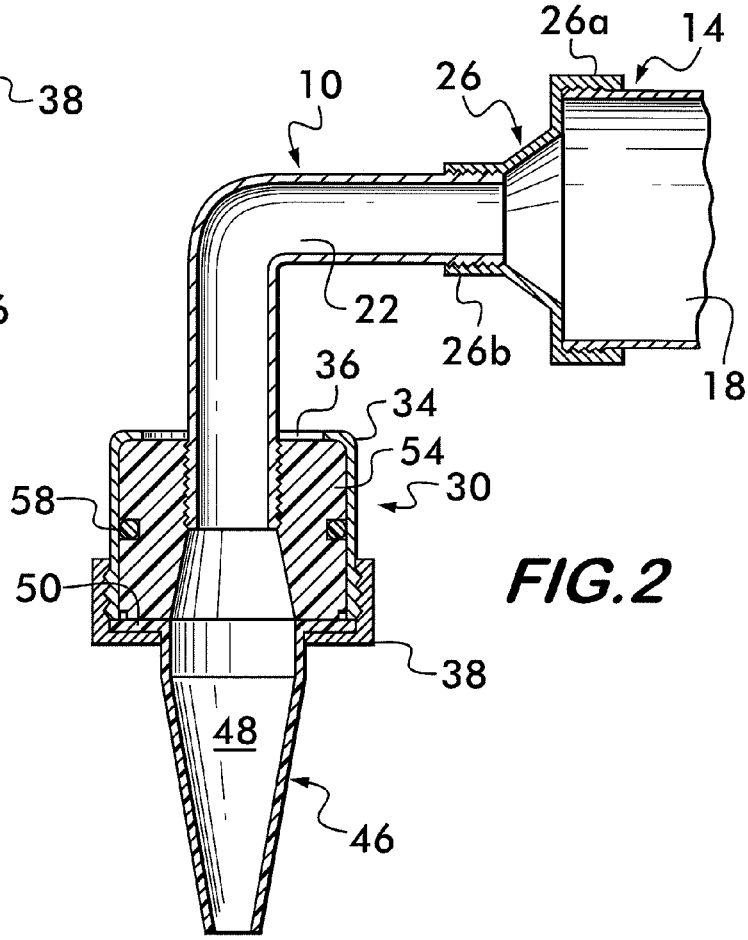
FIG. 2 is a cross-sectional view of the nozzle assembly of the present invention affixed to the dispensing end of a device for dispensing flowable materials such as caulking materials.
Figure 3:
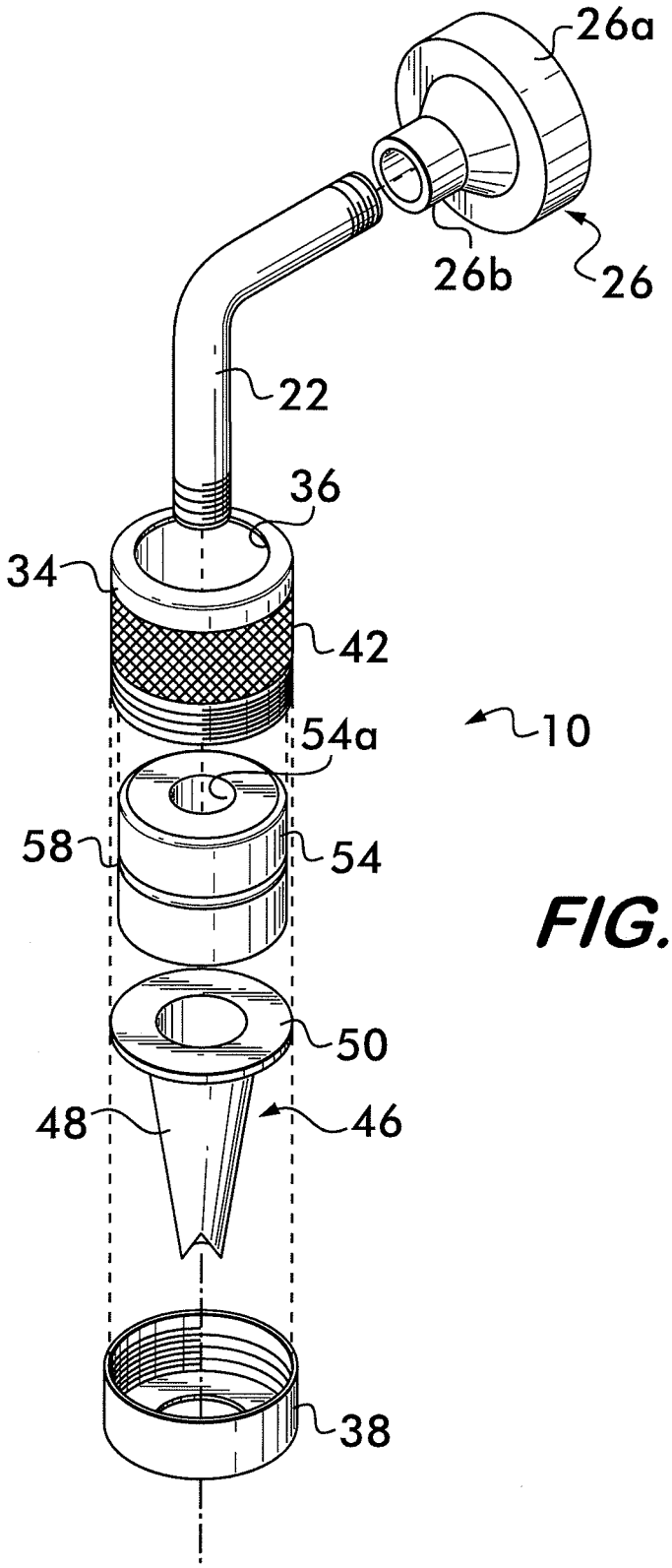
FIG. 3 is an exploded view of the nozzle assembly of the present invention.

Referring now in detail to the various figures of the drawings wherein like reference characters refer to like parts, there is shown at 10 in FIGS. 1-3, a nozzle assembly for use in combination with a device for dispensing flowable materials such as caulking materials, grease, automotive windshield sealant, resins, and the like. The nozzle assembly 10 is arranged to fit on the dispensing end of such a dispensing device, such as a caulking gun 14, which typically includes a barrel 18, only a small portion of which is shown in FIGS. 1 and 2. In particular, the nozzle assembly 10 includes a conduit 22 having an externally threaded inlet end and an externally threaded outlet end. The nozzle assembly 10 is arranged to attach to the dispensing end of the caulking gun 14 by means of a screw-on coupling 26. More specifically, the coupling 26 includes a wider end 26*a* having internal threads (shown in FIG. 2) arranged for threaded engagement with the barrel 18 and a narrower end 26*b*, also having internal threads (shown in FIG. 2), arranged for threaded engagement with the inlet end of the conduit 22. The conduit 22 can be formed of any suitable material, e.g., copper, and is shown in the figures as including two straight sections and an elbow or bend which turns at an angle of approximately ninety degrees. It should be understood that alternatively, the conduit 22 could be straight, or of any other configuration or include one or more bends as required by an operator to best suit the application.

A head assembly 30 is shown mounted over the conduit 22 at the outlet end thereof. The head assembly 30 includes a thin-walled housing member 34 and a cap member 38. The cap member 38 is arranged for threaded engagement with the housing member 34. The housing member 34 includes an opening 36 at its top end to enable passage of the conduit 22 therethrough. As best shown in FIG. 3, the size of the opening 36 in the housing member 34 is somewhat larger than the outside diameter of the conduit 22 passing therethrough. The cap member 38 is also provided with an opening to enable passage of a nozzle 46 therethrough. The opening in the cap 38 is sized to provide a snug fit with the nozzle 46 passing therethrough. The outside surface of the housing member 34 is provided with a knurl 42 or other means for manually gripping the housing member 34 to facilitate manual rotation of the head assembly 30 during dispensing of flowable material from the dispensing device in ways to be described below.

Referring now to FIGS. 2 and 3, a generally cylindrical shaped fitting 54 is shown fitted within the head assembly 30. The fitting 54 is provided with an annular notch or slot for mounting an O-ring 58 thereon to assure a liquid seal exists between the fitting 54 and the housing member 34. The fitting 54 can be formed of any suitable material, e.g., rubber or plastic, and includes a central axial opening 54*a* therethrough. As best shown in FIG. 2, the upper portion of the central opening 54*a* is internally threaded to enable threaded securement of the outlet end of the conduit 22 to the fitting 54. As best shown in FIG. 2, the conduit 22 extends into the central opening 54*a* only a portion of the distance therein, e.g., halfway. The lower portion of the central opening 54*a* flares outwardly as it extends downwardly to match the diameter of the inlet end of the nozzle 46.

The nozzle 46, extending through the opening of the cap member 38, comprises a tapered wall 48 including a wider inlet end, a narrower outlet end, and a skirt 50 at the inlet end which extends radially outwardly. As best shown in FIG. 2, the diameter of the skirt 50 is approximately equal to the outer diameter of the housing member 34 and is arranged to be seated within the cap member 38. The nozzle 46 is fixedly secured to the head assembly 30 due to the skirt 50 being sandwiched between the housing member 34 and the cap member 38, which are shown in threaded engagement with each other. The nozzle 46 may be formed of any suitable material, e.g., plastic or rubber. As best shown in FIGS. 1 and 3, the tapered wall 48 of the nozzle 46 is provided with a triangular cut-out section 60 which extends upwardly from the nozzle outlet end. During dispensing, flowable material will exit the outlet end of the nozzle 46 as well as the cut-out section 60 in the tapered wall 48 to create a dispensed bead.

In use, upon actuation of the dispensing device 14, flowable material will exit the barrel 18 of the device 14 and flow through the conduit 22 and out the nozzle 48 through the outlet end including the cut-out section 60. The cross-sectional shape of the dispensed bead will take on the shape of the cut-out section 60 through which it passes, e.g., triangular. It is important to mention that although the cut-out section 60 is illustrated in FIGS. 1 and 3 as being triangular, this shape is merely exemplary, and other shapes of the cut-out section 60, e.g., round, are contemplated within the scope of this invention based upon the requirements of the application. Upon rotation of the knurl 42 of the head assembly 30 during dispensing of flowable material, the cut-out section 60 will rotate to any one of a plurality of positions to enable the dispensed bead to exit the nozzle assembly 10 in any direction.

For example, in an automotive application, it is required that a bead of sealant having a triangular cross-section be applied to a vehicle frame along a pinchweld in the frame defining the windshield periphery prior to the installation of an automobile windshield. When using a conventional dispensing device to apply such a shaped bead, each time another corner of the windshield periphery is reached, it is necessary for the operator to reposition his body and/or the dispensing device to change the direction in which the bead of sealant is dispensed. Such repositioning is time consuming and inconvenient to the operator. Under the present invention, during dispensing of the sealant bead, the operator grasps the knurl 42 of the head assembly 30. Each time another corner in the vehicle frame is reached requiring a change in direction, instead of the operator repositioning himself and/or the dispensing device, the operator merely rotates the knurl 42 to change the position of the cut-out 60, thus changing the direction from which the bead of sealant exits the nozzle assembly 10. As a windshield has four corners, as each new corner is reached on the vehicle frame, the operator merely rotates the knurl 42 approximately ninety degrees during dispensing to change the direction from which the bead of sealant exits the nozzle assembly 10. In this manner, the bead of sealant may be applied around the vehicle frame defining the windshield periphery thus eliminating the need for such repositioning with each new turn.

Figure 4:
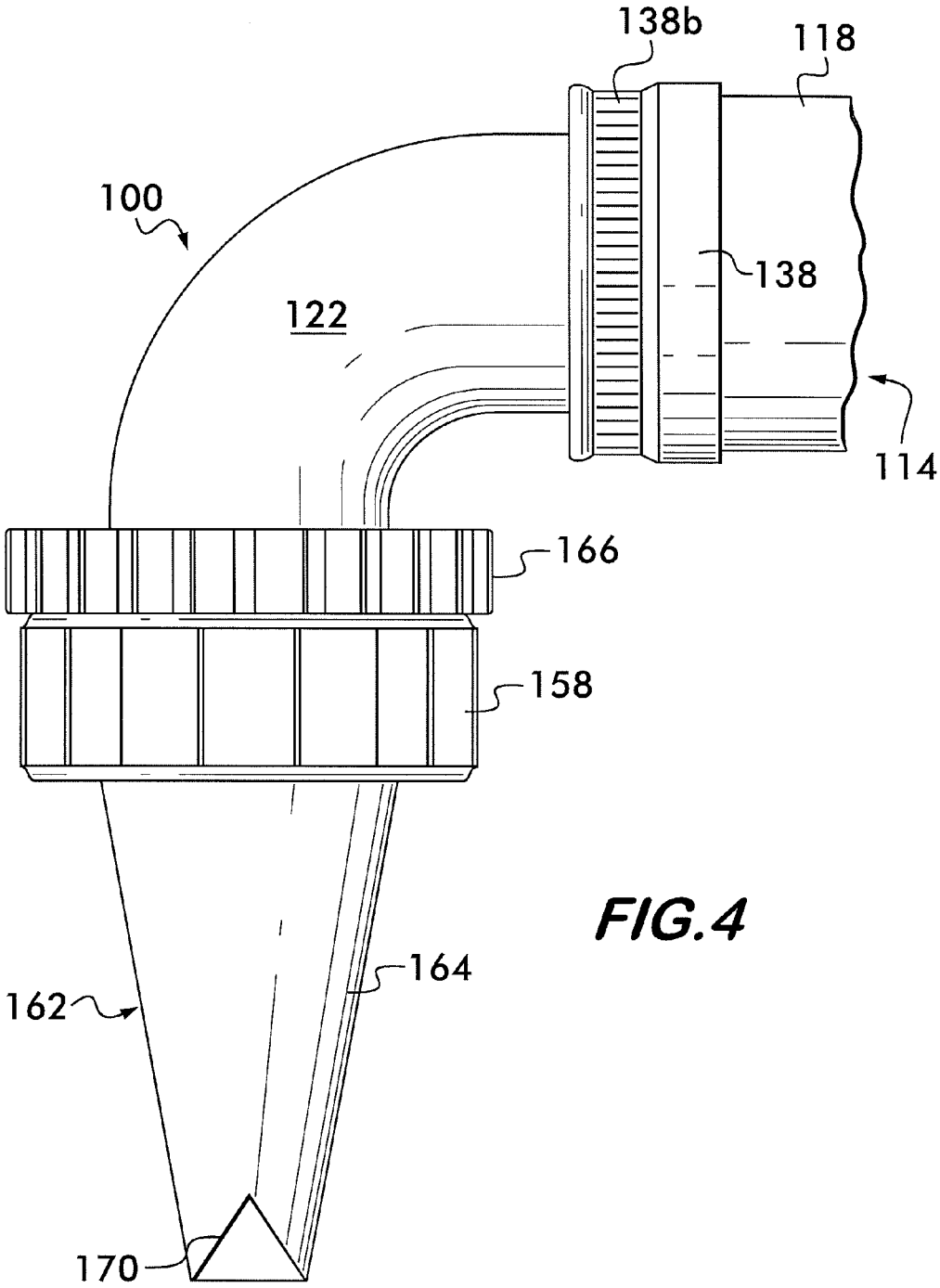
FIG. 4 is a perspective view of a second embodiment nozzle assembly of the present invention affixed to the dispensing end of a device for dispensing flowable materials such as caulking materials.
Figure 5:
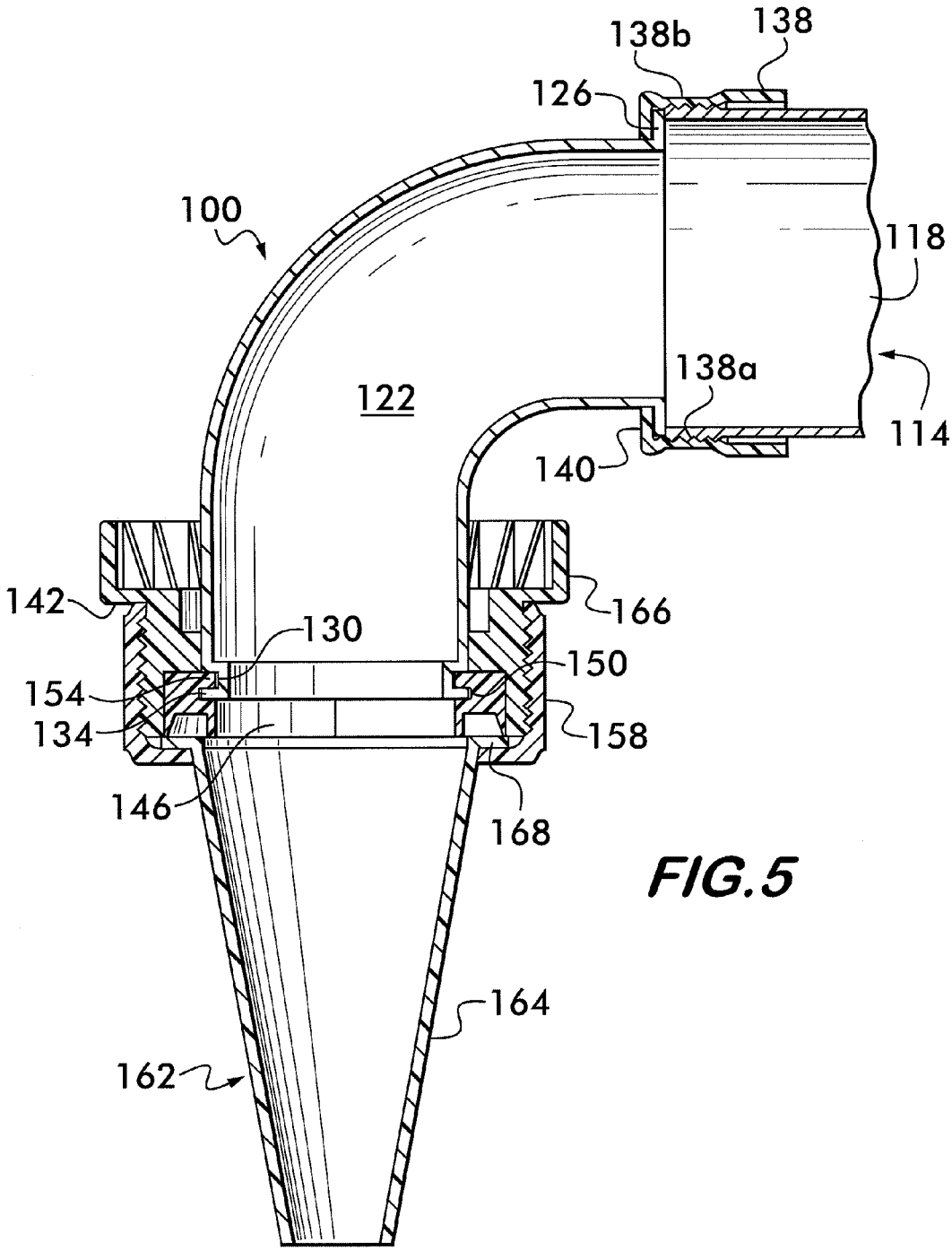
FIG. 5 is a cross-sectional view of the second embodiment nozzle assembly of the present invention affixed to the dispensing end of a device for dispensing flowable materials such as caulking materials.

Referring now to FIGS. 4-6, and 6A, there is shown at 100 a second embodiment nozzle assembly for use in combination with a device for dispensing flowable materials such as caulking materials, grease, automotive windshield sealant, resins, and the like. The nozzle assembly 100 is arranged to fit on the dispensing end of such a dispensing device, such as a caulking gun 114, which typically includes a barrel 118, only a small portion of which is shown in FIGS. 4 and 5. As best shown in FIG. 5, the nozzle assembly 100 includes a conduit 122 having an integral radially-extending flange 126 located at an inlet end. Referring now to FIG. 5, the radially-extending flange 126 extends outwardly beyond the outside diameter of the conduit 122. At the opposite end (or outlet end) of the conduit 122, an outwardly facing groove 130 including an integral lip 134 is shown. The lip 134 extends circumferentially about the conduit 122 and has an outer diameter that is no greater than the outer diameter of the conduit 122. The conduit 122 can be formed of any suitable material, e.g., copper or plastic, and is shown in the figures as including an elbow or bend which turns at an angle of approximately ninety degrees. It should be understood that alternatively, the conduit 122 could be straight, or of any other configuration or include one or more bends as required by an operator to best suit the application.

Figure 6A:
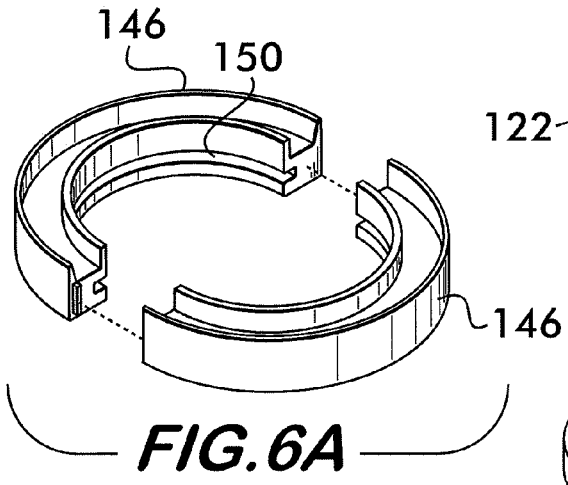
FIG. 6 is an exploded view of the second embodiment nozzle assembly of the present invention; and, FIG. 6A is an enlarged exploded view of the second embodiment nozzle assembly of the present invention.
Figure 6:
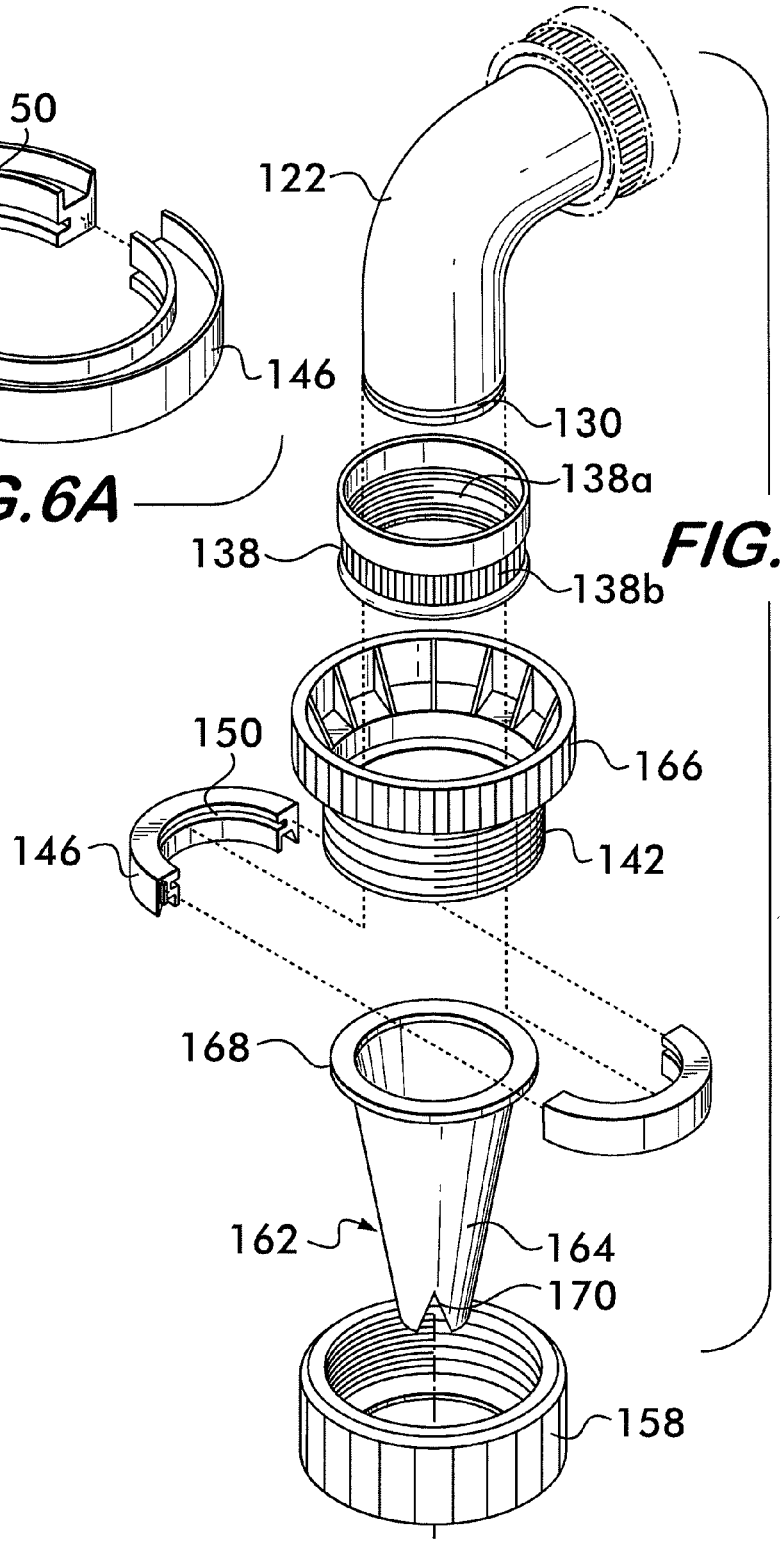

Referring now to FIGS. 5 and 6, a generally ring-shaped front cap 138 having a central opening is arranged to be slid over the conduit 122 from the outlet end toward the inlet end thereof. The front cap 138 includes an inwardly extending flange 140 that comes into abutting relation with flange 126 of the conduit 122 as the cap 138 is slid towards the inlet end of the conduit 122. In this manner, the front cap 138 is retained on the conduit 122 at the inlet end thereof. The front cap 138 includes internal threads 138*a* to facilitate threaded engagement with external threads located on the dispensing end of the dispensing device 114. A knurl 138*b* (best shown in FIGS. 4 and 6) is provided on the exterior surface of the front cap 138 to facilitate secure attachment of the inlet end of the conduit 122 to the dispensing end of the dispensing device 114.

Once the conduit 122 is secured to the dispensing device 114 using the front cap 138, a generally ring-shaped adapter 142 having a central opening is arranged to be slid over and retained on the conduit 122. After the adapter 142 has been slid over the conduit 122, a pair of clips 146 may be fitted in place on the conduit 122 at the outlet end thereof. Referring to FIGS. 5 and 6, each clip 146 is provided with an interior groove 150 including a lip 154. The groove 150 of each clip 146 is arranged to receive the lip 134 of the conduit 122 and the groove 130 of the conduit 122 is arranged to receive the lip 154 of each clip 146. Referring now to FIG. 5, once the clips 146 are fitted in place over the conduit 122 at the outlet end thereof, the adapter 142 may be slid down the conduit 122 towards the outlet end so the clips 146 are retained within a lower recess in the adapter 142. Once in place, the clips 146 are free to rotate about the outlet end of the conduit 122.

Referring now to FIGS. 5 and 6, an internally threaded nozzle cap 158 includes a central opening that is arranged for passage of a nozzle 162 therethrough. The nozzle 162 is provided with a tapered wall 164 and a skirt 168 for retaining the nozzle 162 within the cap 158. As best shown in FIG. 5, the cap 158 includes internal threads and is arranged for threaded engagement with the externally threaded adapter 142 to securely retain the skirt 168 and clips 146 between the adapter 142 and the cap 158.

The outside surface of the adapter 142 is provided with a knurl 166 or other means for manually gripping the adapter 142. During dispensing of flowable material from the dispensing device, manual rotation of the adapter 142 causes rotation of the clips 146, nozzle 162 and cap 158 in unison about the outlet end of the conduit 122. As in the first embodiment, the tapered wall 164 of the nozzle 162 includes a wider inlet end, a narrower outlet end. The nozzle 162 may be formed of any suitable material, e.g., plastic or rubber.

As best shown in FIGS. 4 and 6, the tapered wall 164 of the nozzle 162 is provided with a triangular cut-out section 170 which extends upwardly from the nozzle outlet end. As described in the first embodiment, during dispensing, flowable material will exit the outlet end of the nozzle 162 as well as the cut-out section 170 in the tapered wall 164 to create a dispensed bead. Upon rotation of the knurl 166 during dispensing of flowable material, the cut-out section 170 will rotate to any one of a plurality of positions to enable the dispensed bead to exit the nozzle assembly 100 in any direction. As shown in FIG. 5, the clips 146 are shaped to prevent leakage of dispensed material as it passes out the conduit 122 and across the flange 168 of the nozzle 162.

The devices of the present invention have been described in respect to the particular embodiments thereof set forth in the specification and as illustrated in the drawings. As a result of such disclosure, other variations and modifications may become apparent to those skilled in the art and therefore, no limitation as to the scope of the invention is intended by the specific embodiments disclosed but the scope of the invention is to be interpreted in view of the appended claims.

We claim:

1. A nozzle assembly for use with a device for dispensing a flowable material, said nozzle assembly comprising:

a. a conduit having an inlet end adapted for connecting to the dispensing device, an outlet end, and a passage extending therethrough, said conduit including a first straight section that extends from said inlet end to a bend and a second straight section that extends from said bend to said outlet end; and, b. a rotatable head assembly arranged to be connected to the outlet end of said conduit, said head assembly comprising a nozzle having a larger diameter inlet opening, a smaller diameter outlet opening, and a tapered wall, said nozzle tapered wall comprising a single notch extending proximally from said nozzle outlet opening, said outlet opening and said single notch together forming a dispensing opening from which a bead of flowable material may be dispensed, the direction of dispensing of flowable material through said dispensing opening being alterable by rotation of said head assembly during dispensing, said head assembly arranged to rotate in response to manual actuation to any one of a plurality of positions, said rotatable head assembly additionally comprising an adapter surrounding said conduit at the outlet end thereof, and a cap portion arranged for securement to said adapter, said nozzle being secured between said adapter and said cap portion, and said nozzle extending through a central opening in said cap portion.

2. The nozzle assembly of claim 1, wherein said nozzle is provided with an annular flange extending radially from the inlet end of said nozzle, said flange provided for securement of said nozzle between said adapter and said cap portion.

3. The nozzle assembly of claim 1, wherein threads on said adapter cooperate with threads on said cap portion to enable securement of said cap portion to said adapter.

4. The nozzle assembly of claim 1, wherein said head assembly additionally comprises a retainer for encircling said conduit, said retainer being structured to be rotatable with respect to said conduit during rotation of said head assembly.

5. The nozzle assembly of claim 4, wherein said adapter is provided with an annular well for receiving said retainer therewithin.

6. The nozzle assembly of claim 4, wherein said retainer comprises a pair of arcuate clips, which when joined together, encircle said conduit.

7. The nozzle assembly of claim 6, wherein said conduit is provided with an annular flange at said outlet end and wherein said retainer is provided with an annular recess for receiving said annular flange of said conduit therein.

8. The nozzle assembly of claim 1, wherein said adapter includes an exterior surface having ridges or grooves to facilitate manual rotation.

9. The nozzle assembly of claim 8, wherein said ridges or grooves form a knurled surface.

* * * * *